United States Patent [19]

Miura

[11] Patent Number: 4,668,844

[45] Date of Patent: May 26, 1987

[54] SWITCH DEVICE WITH PIVOTED INTERLOCK PLATE

[75] Inventor: Teiichi Miura, Furukawa, Japan

[73] Assignee: Alps Electric Co., Ltd., Japan

[21] Appl. No.: 793,682

[22] Filed: Oct. 31, 1985

[30] Foreign Application Priority Data

Oct. 31, 1984 [JP] Japan ..... 59-163746[U]

[51] Int. Cl.[4] ..... H01H 9/26

[52] U.S. Cl. ..... 200/5 E; 200/50 C

[58] Field of Search ..... 200/5 R, 5 B, 5 C, 5 D, 200/5 E, 5 EA, 5 EB, 5 OC; 74/483 PB

[56] References Cited

U.S. PATENT DOCUMENTS

| | | | |
|---|---|---|---|
| 1,424,402 | 8/1922 | Hartman | 200/5 E |
| 2,523,786 | 9/1950 | Soreng | 74/483 PB X |
| 2,903,687 | 9/1959 | Baer et al. | 200/5 E X |
| 3,142,198 | 7/1964 | Williams | 200/5 EA |
| 3,166,644 | 1/1965 | Feldmayer | 74/483 PB X |
| 3,617,661 | 11/1971 | Nome et al. | 200/5 E X |
| 3,778,564 | 12/1973 | Nocella et al. | 200/5 E X |
| 3,836,736 | 9/1974 | Golbeck | 200/5 C X |
| 3,889,075 | 6/1975 | Morrell et al. | 200/5 E |
| 4,122,316 | 10/1978 | Iwasaki et al. | 200/5 E X |
| 4,309,579 | 1/1982 | Kondo et al. | 200/5 E |

OTHER PUBLICATIONS

Japanese Utility Model Laid-Open Publication No. 126429/84; Fujitsu, Tenkiki; Aug. 25, 1984; "Twin Push Switch".

*Primary Examiner*—J. R. Scott

*Attorney, Agent, or Firm*—Guy W. Shoup

[57] ABSTRACT

A switch assembly has two rows of pushbutton switches and a rocking plate in between the two rows having projections engaging the switches for preventing the switches of one row from being depressed when any switch in the opposing row is depressed. The rocking plate is pivotably mounted on a shaft such that it can be axially displaced to release the projections from the switches and allow switches from either row to be actuated simultaneously.

3 Claims, 6 Drawing Figures

SWITCH DEVICE WITH PIVOTED INTERLOCK PLATE

BACKGROUND OF THE INVENTION

This invention relates to a switch device, and more particularly to a multiple push switch which is interlockingly arranged in opposite rows.

Conventionally, a multiple push switch which is interlockingly arranged in opposite rows has been used for carrying out alternate connection of circuits by pushing an operating shaft directly or indirectly in an axial direction by means such as, a lever, knob or button. However, in such a conventional push switch, it is impossible to prevent the switches in opposite rows from being simultanenously actuated.

SUMMARY OF THE INVENTION

Accordingly, it is an object of the present invention to provide a switch device which may prevent the switches in opposite rows from being simultaneously actuated so that circuits associated with opposite rows are actuated in an exclusive manner.

According to the present invention, the switch device comprises a switch body having switches arranged in substantially opposed relation with each other, the switches are operated by actuators formed to have a lever portion and a plate pushing portion hereafter referred to as a push member; a rocking plate adapted to rock beneath the push members switch body, the being provided with bearing portions on both sides thereof and with an opening between the push members, the rocking plate being provided with bent portions on both sides thereof; and a shaft rotatably supported between the bearing portions and supporting the bent portions of the rocking plate so as to rotate the rocking plate.

Other objects and advantages of the invention will become apparent from the following description and accompanying drawing.

DETAILED DESCRIPTION OF THE PREFERRED EMBODIMENT

Figure 1:
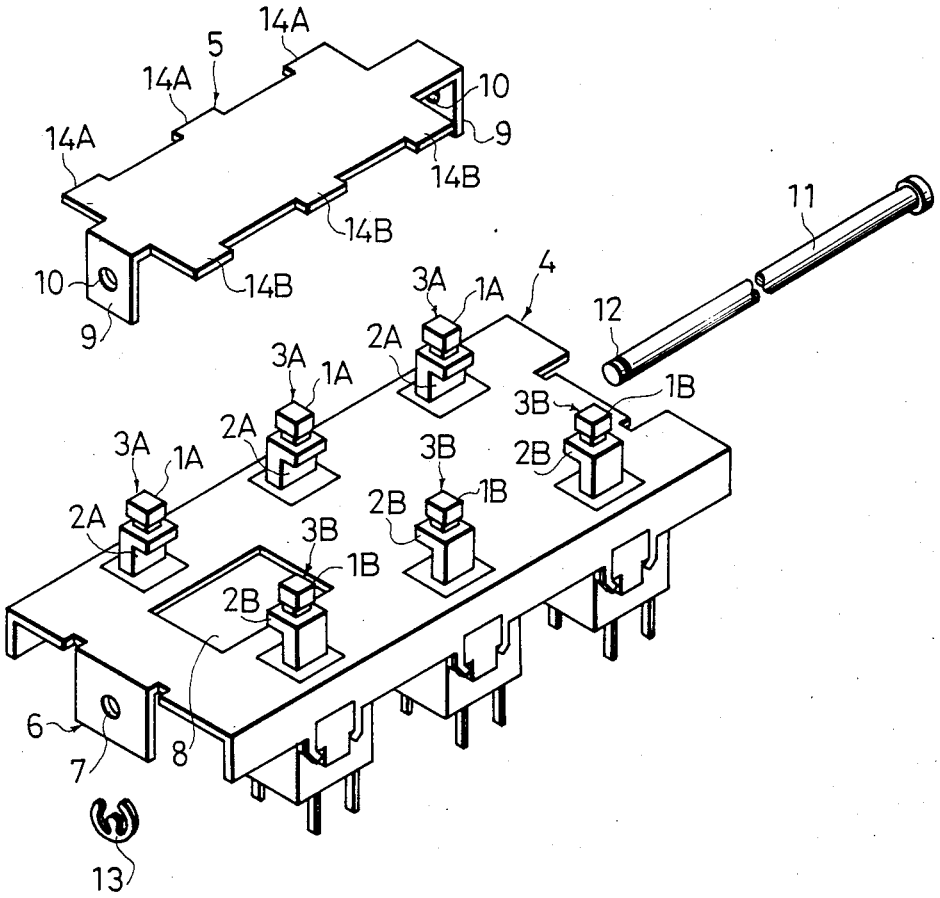
FIG. 1 is an exploded view in perspective of a switch device of a preferred embodiment according to the present invention.

Referring to FIGS. 1 to 6, reference numerals 1A and 1B designate levers, and reference numerals 2A and 2B designate push members. The levers 1A and 1B and the push members 2A and 2B are combined with each other to form switch actuators 3A and 3B. In the preferred embodiment, two rows of the actuators 3A and 3B are arranged in substantially opposite position on a switch body 4. A rocking plate 5 is arranged between the push members 2A and 2B. The switch body 4 is provided with bearing portion 6 on both sides thereof. The bearing portions 6 have shaft holes 7. The switch body 4 is also provided with an opening 8 between the push members 2A and 2B. The rocking plate 5 is provided with bent portions 9 on both sides thereof. The bent portions 9 have shaft holes 10. A shaft 11 is supported between both the bearing portion 6 of the switch body and is connected to the rocking plate 5 at the shaft holes 10. The shaft 11 is provided with a groove 12 receiving an E-washer 13. The rocking plate 5 is further provided with horizontal projections 14A and 14B.

In connection with the above-mentioned structure, there will now be described assembling order of a switch device with reference to FIGS. 1 to 3.

Figure 2:
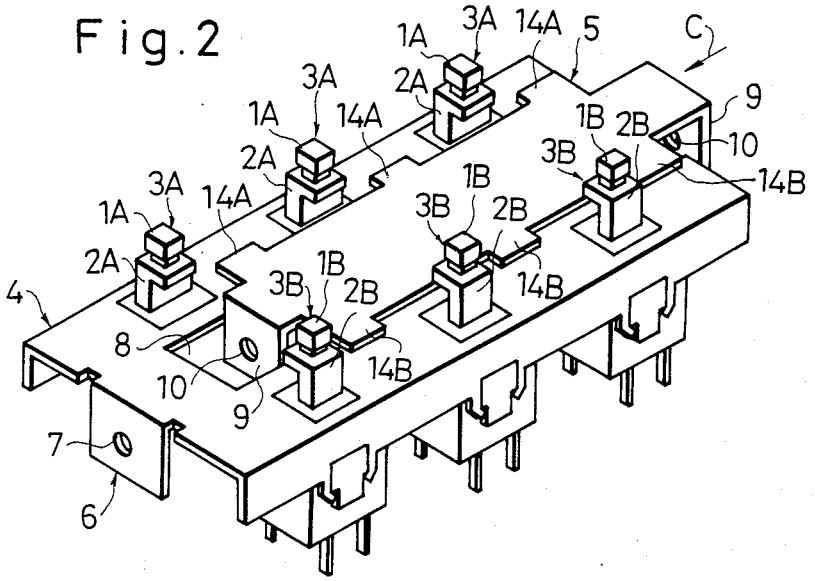
FIGS. 2 and 3 are perspective views showing assembling order of the switch device.

As shown in FIG. 2, the rocking plate 5 is first mounted on the switch body 4 in such a manner that the projections 14A and 14B are clear of the actuators 3A and 3B. One of the bent portions 9 is inserted in the opening 8 of the switch body 4, while the other of the bent portions 9 is positioned outside the bearing portion 6 on an opposite side of the opening 8.

Then, the rocking plate 5 is slid forward on the switch body 4 as depicted by an arrow C until the projections 14A and 14B sit under the push members 2A and 2B.

Figure 3:
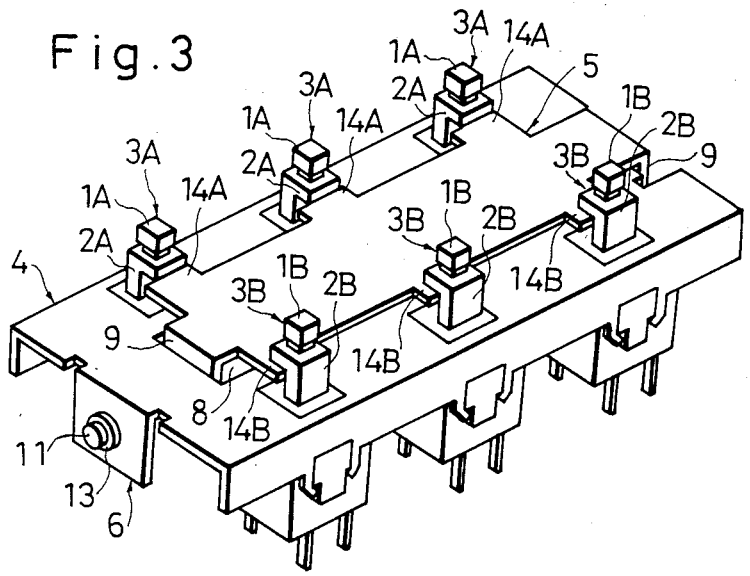

Thereafter, the shaft 11 is inserted into one of the shaft holes 10 of the rocking plate 5, one of the shaft holes 7 of the switch body 4, the other of the shaft holes 10, and the other of the shaft holes 7 in this order, and then the washer 13 is engaged with the groove 12 of the shaft 11 as shown in FIG. 3.

The shaft 11 is supported by the bearing portions 6 of the switch body 4 to rotate about the axis between the bearings 6. The shaft may be integrally fixed to the rocking plate 5 at the shaft holes 10 by pressing or other means.

Thus, the shaft 11 is rotatably supported to the switch body 4 by the bearing portions 6, and shaft permits the rocking plate 5 to rotate on its axis which is located below the top of the switch body.

In the following, there will be described operation of the switch device as assembled in the above-mentioned manner with reference to FIGS. 4 to 6.

Figure 4:
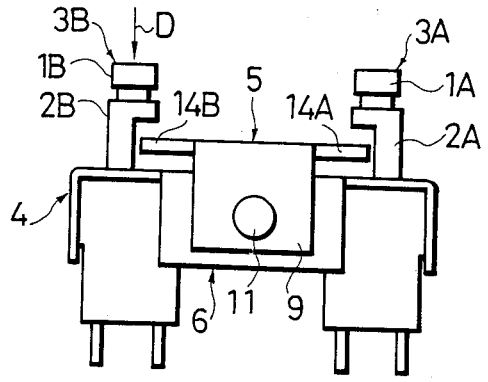
FIGS. 4, 5, and 6 are right side views of the switch device of FIG. 3.

Referring to FIG. 4 which shows a side view of the switch device having two rows of the interlocking actuators 3A and 3B, where the actuators 3A and 3B are both in an unretained condition.

Figure 5:
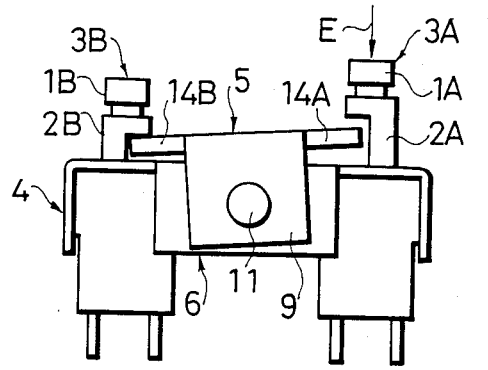

Under this mutually unretained condition, when the actuator 3B is depressed as indicated by arrow D, the lever 1B and the push member 2B are pushed down to the position shown in FIG. 5, and the projection 14B of the rocking plate 5 is forced down by the push member 2B.

In other words, since the rocking plate 5 is fixed to rotate on the shaft 11 as mentioned above, the projection 14B is pushed down by a lowering motion of the push member 2B, and the rocking plate 5 is rotated counterclockwise about the shaft 11. Accordingly, as shown in FIG. 5, the left-hand portion of the rocking plate 5 with respect to the shaft 11 is held down while the right-hand portion of the rocking plate 5 is upwardly inclined.

In this manner, under such a condition where the lever 1B is depressed, the lever 1B is retained by an interlocking plate (not shown), the actuator 3B is in a retained condition.

To release the retained conditions of the lever 1B, the lever 1A is depressed in a direction as depicted by an arrow E as shown in FIG. 5.

When the lever 1A is depressed, an interlocking plate (not shown) is moved before the push member 2A comes into contact with the projection 14A, and the lever 1B is brought into an unretained condition as shown in FIG. 4. Then, in the case that the lever 1A continues to be depressed, the projection 14A of the rocking plate 5 is pushed down by the push member 2A, and the rocking plate 5 is rotated clockwise about the shaft 11, whereby the rocking plate 5 as a whole is inclined on the right-hand side thereof. In this manner, under such a condition where the lever 1A is depressed, the lever 1A is retained by an interlocking plate (not shown), and the actuator 3A is retained.

To release the retained condition of the switch 3A, the lever 1B is depressed until the push member 2B nearly comes into contact with the projection 14B to move the interlocking plate (not shown) and release the lever 1A. Then, the lever 1B is undepressed to bring the actuator 3B into the unretained condition as shown in FIG. 4.

As is mentioned above, both the actuators 3A and 3B are designed to effect an interlocking operation between both the rows.

Figure 6:
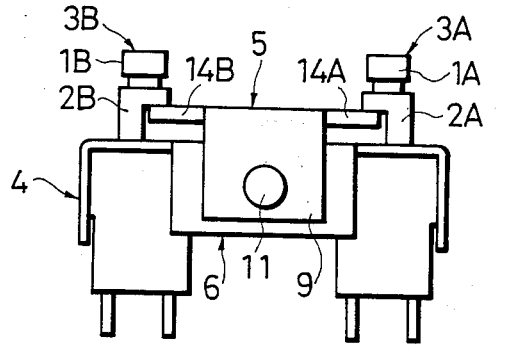

Thereafter, when both actuators 3A and 3B are simultaneously depressed from the condition shown in FIG. 4, they are brought into a blocked condition as shown in FIG. 6.

That is to say, when both the levers 1A and 1B are simultaneously depressed, both the push members 2A and 2B are pushed down, and accordingly both the projections 14A and 14B are also pushed down. However, since the distance for the push members 2A and 2B to come into contact with the projections 14A and 14B is smaller than the distance where the levers 1A and 1B are retained by the interlocking plates (not shown), neither of the levers 1A and 1B can be brought into the retained condition.

In other words, even when the levers 1A and 1B are simultaneously depressed, both of pushing forces transmitted from the push members 2A and 2B to the projections 14A and 14B are identical and accordingly both the pushing forces are balanced to allow the rocking plate 5 to be horizontal as shown in FIG. 6. Thus, the actuators 3A and 3B cannot be brought into the retained condition.

In this manner, according to the switch device of the present invention, when both the actuators 3A and 3B are simultaneously depressed, the rocking plate 5 is maintained horizontal with respect to the shaft 11, and both switches may not be brought into the retained condition.

Further, when both actuators 3A and 3B are simultaneously depressed by an uneven force such that the pushing forces applied on the switches 3A and 3B are unbalanced, only one of the switches 3A and 3B can be brought into the retained condition. Therefore, it is possible to prevent both the switches 3A and 3B from being brought into the retained condition simultaneously.

Having thus described the preferred embodiment of the invention, it should be understood that numerous structural modifications and adaptations may be restored to without departing from the spirit of the invention.

What is claimed is:

1. A switch assembly comprising:

an elongated switch body having an external surface;

two rows of pushbutton switches, each row having a plurality of switches arranged within said switch body in a longitudinal direction opposite from those of the other row, each of said switches including a push member extending through said external surface so as to be actuatable externally in up and down directions;

a pivotable plate arranged on said external surface of said switch body in between the two rows of push members of said switches having two corresponding rows of projections extending from respective sides thereof, each projection being positioned so as to be engageable with a respective push member of each of said switches, said plate being pivotable along a central longitudinal axis thereof so as to incline one row of projections on one side when the other side thereof is pushed downward, said projections of the one side being inclined toward the push members of the switches of one row when any push member of a switch of the other row is depressed to engage the respective projection on the other side of said pivotable plate to pivot the other side of the plate downward;

said switch body being provided with bearing portions at its ends in the longitudinal direction;

and a shaft supported on said bearing portions and pivotably mounting said pivotable plate along its central axis thereon with said two rows of projections positioned to be engageable with the corresponding ones of said two rows of switches;

whereby depression of a push member of any of the switches on one side is prevented if one push member of a switch on the other side is being depressed.

2. A switch assembly according to claim 1, wherein said pivotable plate has bent portions at its ends in the elongated direction, and said bent portions are provided with shaft holes for mounting said pivotable plate on said shaft.

3. A switch assembly according to claim 2, wherein said switch body has an opening toward one end into which one of said bent portions is received during assembly of said pivotable plate, said plate being axially slidable by said bent portions along said shaft to the assembled position at which said two rows of projections are positioned to be engageable with the corresponding ones of said two rows of switches.

* * * * *